United States Patent [19]

Love et al.

[11] Patent Number: 5,044,427

[45] Date of Patent: Sep. 3, 1991

[54] HEAT EXCHANGER

[75] Inventors: Scott D. Love; Stone P. Washer, both of Bartlesville, Okla.

[73] Assignee: Phillips Petroleum Company, Bartlesville, Okla.

[21] Appl. No.: 575,724

[22] Filed: Aug. 31, 1990

[51] Int. Cl.[5] ..... F28F 7/00

[52] U.S. Cl. ..... 165/76; 165/159

[58] Field of Search ..... 165/76, 77, 159, 161, 165/162, 38

[56] References Cited

U.S. PATENT DOCUMENTS

| | | | |
|---|---|---|---|
| 2,940,735 | 6/1960 | Marsh | 165/159 X |
| 3,400,758 | 9/1968 | Lee | 165/159 |
| 4,246,872 | 1/1981 | Skinner et al. | 122/510 |
| 4,412,582 | 11/1983 | Mecozzi et al. | 165/76 |
| 4,490,896 | 1/1985 | Small | 29/157.3 |

*Primary Examiner*—Allen J. Flanigan

*Attorney, Agent, or Firm*—Charles W. Stewart

[57] ABSTRACT

A baffle in a heat exchanger having two sections hingedly connected so as to facilitate removal of the tube bundle. A top section of the baffle defines a plurality of apertures through which tubes of a removable bundle extend and has edges one of which is connected to an edge of the bottom section of the baffle in a manner which permits the bottom section to rotate relative to the top section when the heat exchanger tube bundle is being removed. When the novel features of this invention are incorporated in a heat exchanger, removal of the tube bundle is facilitated.

10 Claims, 3 Drawing Sheets

HEAT EXCHANGER

The present invention relates generally to improved heat exchange apparatus and, more specifically, is directed to the provision of an improved baffle plate for use in conventional heat exchangers. In another aspect, the invention relates to an improved method for operating a heat exchange apparatus.

BACKGROUND OF THE INVENTION

Deposits on the internal surfaces of heat exchangers have long been a major problem in the art. Besides decreasing the heat transfer capabilities of the heat exchanger, severe deposits also decrease fluid throughput and raise the pressure drop thus making the heat exchanger more expensive to operate due to higher pumping costs and less efficient heat transfer. Deposits also create problems during the disassembly of heat exchangers for maintenance or repair.

For example, in shell and tube heat exchangers used in acid services, the deposits can become so severe that the tube bundle is effectively cemented into the shell. The cost of cleaning the unit or repairing even a small leak in such a locked-up unit can be staggering, because the bundle is often destroyed by intention or by accident when it is attempted to remove the bundle from its shell.

It would thus be extremely desirable to provide a heat exchanger which is easily dismantled for cleaning or repair, despite the presence of profuse deposits on its interior surfaces. It would also be extremely desirable to provide such a readily dismantled heat exchanger in which available components are utilized to a large extent, thus minimizing the costs associated with its implementation.

OBJECTS OF THE INVENTION

It is therefore an object of this invention to provide an improved heat exchanger which will increase the ease and economy of tube bundle removal from a shell of a shell-and-tube heat exchanger despite the presence of deposits on the parts and interior surfaces of the shell.

SUMMARY OF THE INVENTION

According to one embodiment of the invention, a baffle is provided in a heat exchanger having a top section defining a plurality of apertures through which the tubes of a removable bundle extend and having a first edge, a second edge, and a third edge with the shape of said third edge corresponding to the shape of the inside surface of said shell, a bottom section having a first edge and a second edge with the shape of said second edge corresponding to the shape of the inside surface of said shell, and hinging means connecting said first edge of said bottom section to said first edge of said top section for allowing said bottom section to rotate relative to said top section.

According to another embodiment of this invention, a removable tube bundle of a heat exchanger is equipped with a baffle comprising a top section defining a plurality of apertures through which the tubes of said removable bundle extend and having a first edge, a second edge, and a third edge with the shape of said third edge corresponding to the shape of the inside surface of said shell, a bottom section having a first edge and a second edge with the shape of said second edge corresponding to the shape of the inside surface of said shell, and hinging means for connecting said first edge of said bottom section to said first edge of said top section and is pulled in a direction so as to cause said bottom section to pivot about said hinging means in a direction opposite the direction in which said removable bundle is being pulled and so as to remove said removable bundle from said shell.

BRIEF DESCRIPTION OF DRAWINGS

Other aspects, objects, and advantages of this invention will become apparent from a study of this disclosure, appended claims, and the drawings in which:

DETAILED DESCRIPTION OF THE INVENTION

Figure 1:
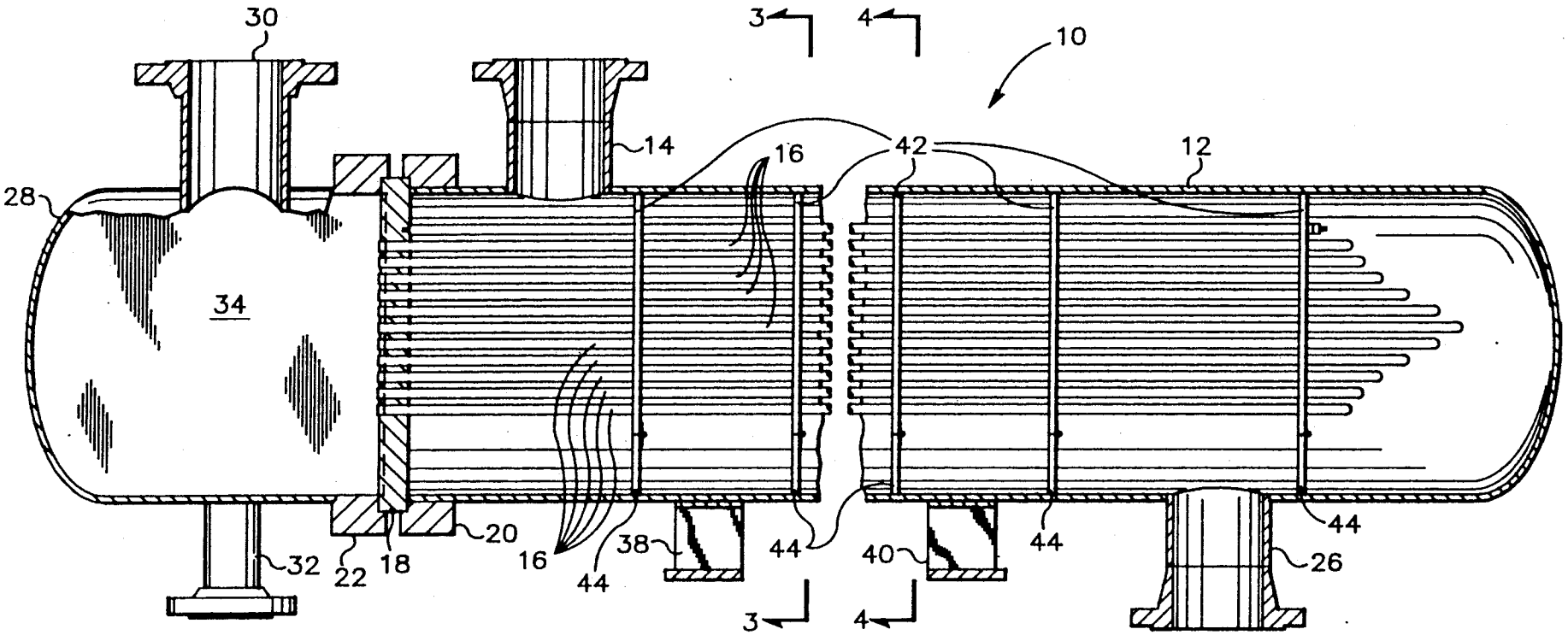
FIG. 1 is a cross-sectional view of a shell-and-tube heat exchanger which is taken along the center line thereof and illustrates certain features of the present invention.

Now referring to FIG. 1 wherein is depicted a shell-and-tube heat exchanger 10 comprising shell 12 and tube bundle 14. The tube bundle 14 is composed of a plurality of U-shaped tubes 16 affixed to tube sheet 18 by any commonly used technique for rolling tubes inside drilled tube holes. Tubes 16 of tube bundle 14 and tube sheet 18 can be arranged in any commonly used symmetrical pattern, such as in a triangular pitch or a square pitch, and they can be made of any variety of material which can include, for example, steel, copper, monel, admiralty brass, aluminum bronze, aluminum, and the stainless steels. The preferred embodiment, however, is to arrange tubes 16 in a square pitch pattern and to fabricate tubes 16 from a monel material. As shown in FIG. 1, tube bundle 14 is of the removable, U-tube type having a single tube sheet 18, but this invention is not limited to U-tube type construction and may be of any type of construction which allows for the removal of tube bundle 14 from shell 12 including, for example, floating head type tube bundles. Tube sheet 18 is held in place by shell flange 20 and bonnet head flange or head flange 22.

Shell 12 is provided with an outlet nozzle 24 and an inlet nozzle 26 spaced as shown in FIG. 1 to induce flow of shell-side fluid across and along the external length of tubes 16 of tube bundle 14. This one-pass, shell-side fluid flow is a preferred arrangement under one embodiment of this invention. Generally, it is the most commonly used flow arrangement in typically designed shell-and-tube heat exchangers; however, other shell-side flow arrangements are possible, such as, for example, split-flow, double split-flow, divided flow and cross flow which require either additional nozzles or different nozzle arrangements, or both.

A stationary front-end bonnet head 28 having inlet nozzle 30, outlet nozzle 32 and one vertically oriented pass partition 34 is equipped with bonnet head flange or head flange 22 for assembly with shell 12 by bolts (not shown) passing through head flange 22 and opposing shell flange 20. Any number of pass partitions can be incorporated within bonnet head 28 and in any suitable arrangement so as to direct the tube-side fluid flow in a desired flow pattern through tubes 16. It is preferred, however, that a single pass partition 34 be used, which will provide a two-pass fluid flow through tubes 16. While it is generally preferred to use bolts and flanges as a fastener means, any other suitable means, such as, for example, clamps and latches, for connecting stationary front-end bonnet head 28 and shell 12 with tube sheet 18 therebetween can be used. Flanges 20 and 22 will clamp on tube sheet 18 in a closed position. A joint is formed between the outer edge of pass partition 34 and a partition groove 36 which is formed in the face of tube sheet 18. This joint is formed by inserting the outer edge of pass partition 34 into the partition groove. The joint can be sealed with a gasket and with force created by the torquing of the bolts which connect head flange 22 and shell flange 20. The shell 12 is provided with support saddles 38 and 40 for support and mounting upon a foundation.

Figure 2:
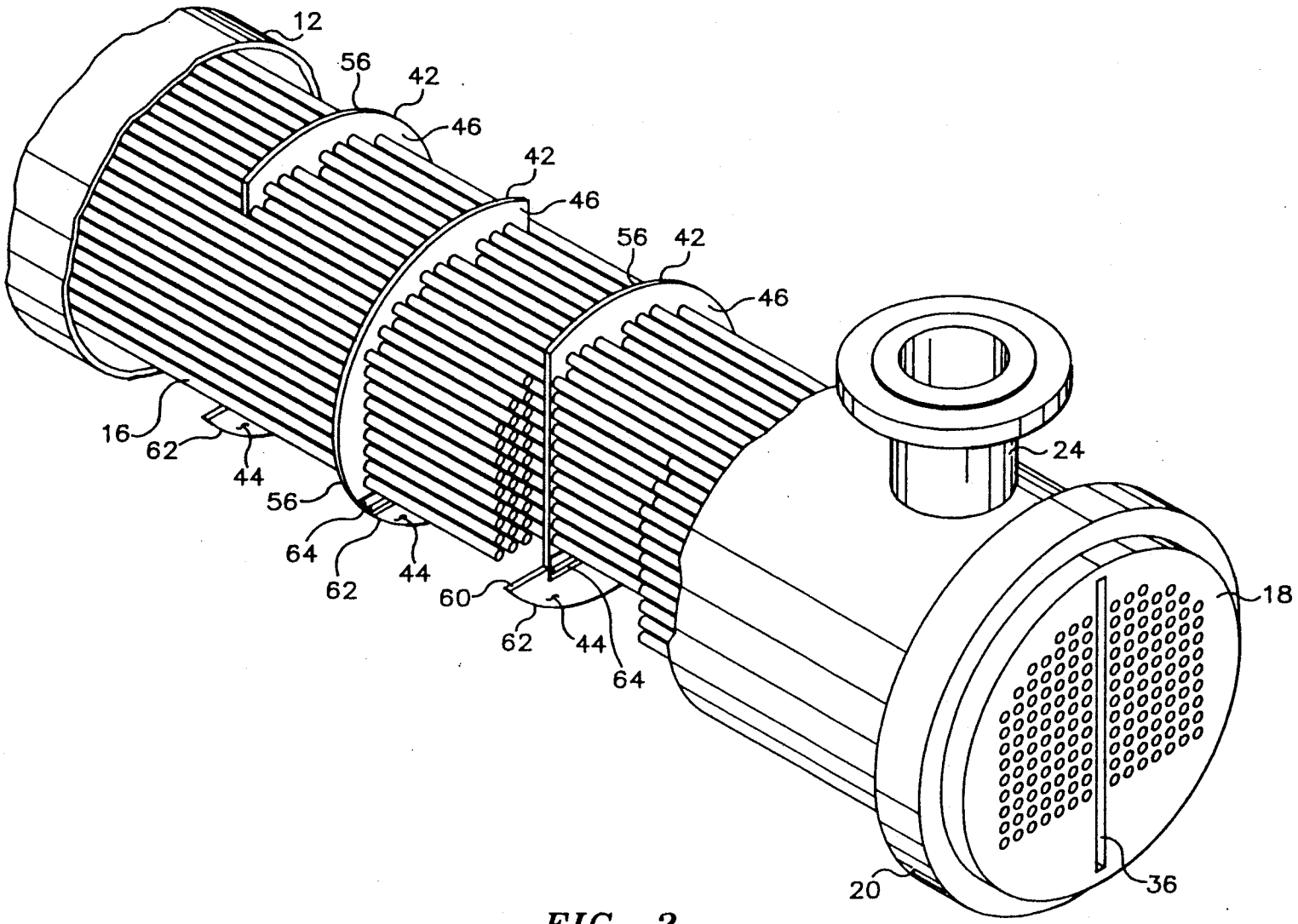
FIG. 2 is an isometric view of the tube bundle and the baffle plates depicted in FIG. 1 and illustrating the features of this invention.

Supporting the tubes 16 of tube bundle 14 and directing the flow of fluid through shell 12 are baffle plates 42 which, as shown in FIG. 1 and FIG. 2, can be spaced at convenient distances along essentially the full length of tubes 16. Baffle plates 42 improve heat transfer by inducing turbulent fluid flow and by causing the shell-side fluid to flow at right angles to the axes of tubes 16.

A problem which commonly occurs in heat exchangers used under severe service conditions such as in acid service is the formation and deposition of scale on the tube surfaces and the internal parts within the heat exchanger shell. In heat exchangers operating in such services, there is a particular tendency for scale to accumulate on the surface of the bottom tube rows of the tube bundle and to build-up in the lower section of the heat exchanger shell. Additionally, after the deposits become so severe, the tube bundle and its internal parts, for instance, the baffles, can be effectively cemented in place within the shell. Due to the accumulation of the scale, it becomes very difficult for operators to remove or pull the removable tube bundles for periodic cleaning without damaging the tubes and the tube bundle. To resolve these problems, an improvement in the tube bundle and baffle has been developed.

Figure 5:
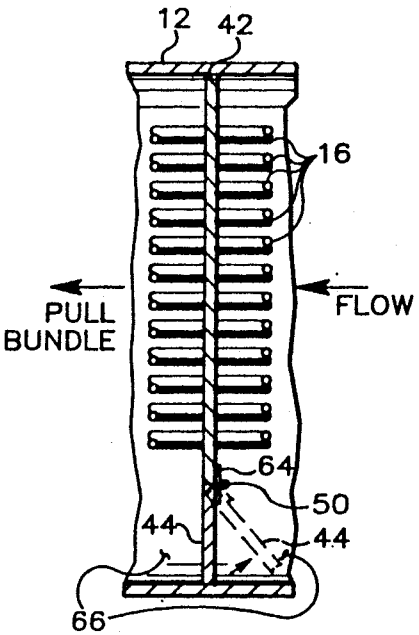
FIG. 5 is a partial cross-sectional view taken along line 5—5 of FIG. 3 more clearly illustrating the operation of the improved baffle plate of the present invention.
Figure 4:
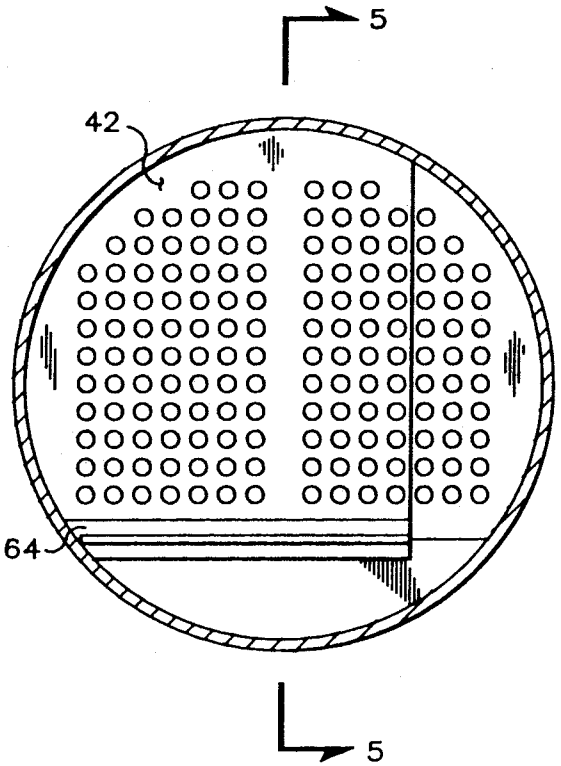
FIG. 4 is an enlarged cross-sectional view taken along line 4—4 of FIG. 1 which more clearly illustrates another improved baffle plate constructed in accordance with the present invention.

The improved structure of baffle plates 42 is shown in greater detail in FIGS. 2, 3, 4, and 5. Baffle plates 42 can be manufactured from any suitable material including, but not limited to, carbon steel, copper, monel, admiralty brass, aluminum bronze, aluminum, the stainless steels, and normally solid, synthetic resin materials. Baffle plates 42 have two sections comprising a bottom section 44 and a top section 46. Top section 46 is provided with apertures 48 formed by any suitable means, such as by drilling, punching and molding, for inserting tubes 16 therethrough. The apertures 48 can be arranged in any desirable or commonly used pattern such as in triangular pitch, square pitch, or rotated square pitch patterns. In a preferred embodiment of the invention, the top section 46 is manufactured from a single, vertical segmental or cross-flow type baffle having a bottom portion removed so as to form a horizontal first edge or first end 50 as shown in FIG. 5. While it is preferred that a single, vertical segmental baffle be used, any other conventional type baffle may be used including, but not limited to, double segmental baffles, triple segmental baffles and rotated single segmental baffles, provided that each incorporates the important features of this invention.

Figure 3:
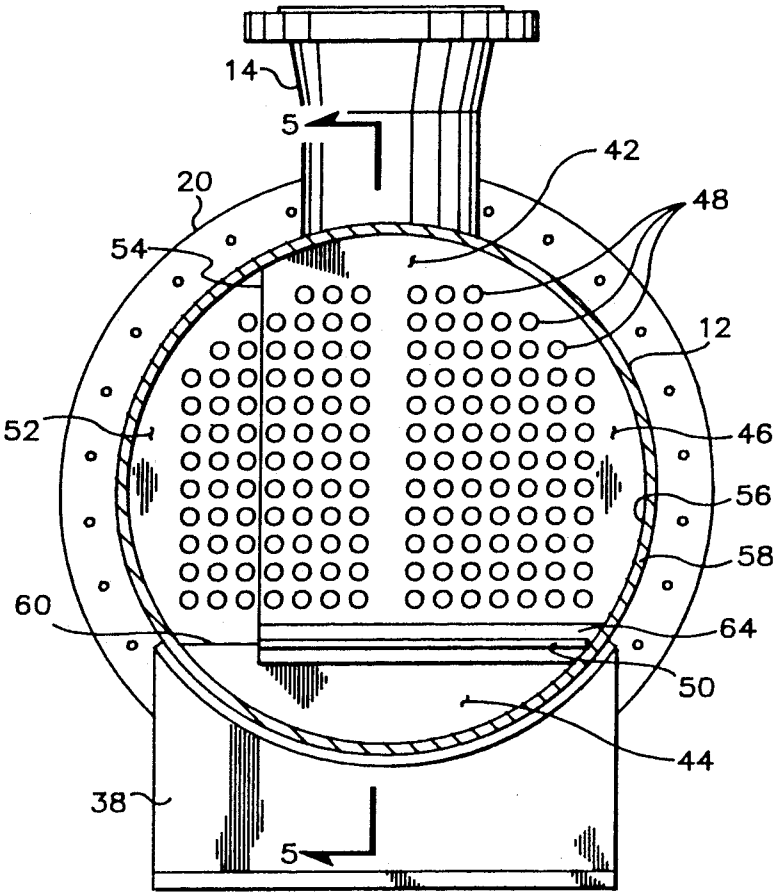
FIG. 3 is an enlarged cross-sectional view taken along line 3—3 of FIG. 1 which more clearly illustrates an improved baffle plate constructed in accordance with the present invention.

Referring again to FIG. 3, there is shown a cross-sectional view of shell 12 and an elevational view of baffle plate 42. Top section 46 is shown in FIGS. 3 and 5 as having three edges or ends. Horizontal first edge or first end 50, as previously described, is formed horizontally along the bottom portion of top section 46. It is preferred that horizontal first edge 50 be a straight, horizontal edge extending perpendicularly from vertical second edge or second end 54 to the outer perimeter of baffle 42. The third edge or third end 56 is the outer perimeter of baffle 42, the shape of which is defined by and corresponds to the pattern of the inside surface of shell 12. Any suitably shaped shell can be used as an embodiment of this invention including, for example, shells defining polygons, ellipses, rectangles, parallelograms and parabolas. Preferably, however, shell 12 is cylindrical in shape defining a circular pattern thereby requiring third edge 56 to have a circular pattern similar to that of an arc or a segment of a circle circumference.

Bottom section 44 is a solid plate having the shape of a circular segment, manufactured from material similar to that used for top section 46, having a horizontal top edge or first end 60 and a bottom edge or second end 62. The shape of bottom edge 62 is defined by and corresponds to the pattern of the inside wall of shell 12, which is preferably a circular pattern, thereby requiring bottom edge 62 to have a circular pattern similar to that of an arc or a segment of a circle circumference. Top edge 60 is substantially horizontal and forms a chord segment of bottom section 44 which abuts against or comes to within close proximity of the horizontal first edge 50 of top section 46. Top edge 60 is hingedly attached to first edge 50 of top section 46 by any suitable hinging means 64. Any suitable type of hinge can be used as hinging means 64 which allows bottom section 44 to swing or rotate relative to top section 46. It is a preferred aspect of this invention for the hinge 64 to only allow single or unidirectional rotation of bottom section 44 from the plane of the top section 46. Any method can be used to provide for this unidirectional rotation including, but not limited to, the choice of hinging means 64 used, an additional element attached to baffle plate 42 to serve as a stop to prevent the rotation of bottom section 44 in the undesirable direction, or any other suitable element which will provide for the desired unidirectional rotation.

In a preferred design of baffle plate 42, a baffle cut or opening, which permits and directs the flow of shell-side fluid perpendicular across the axes of tubes 16 and along the longitudinal axes of tubes 16 in a zig-zag or similar type flow pattern, is defined by three boundaries comprising the inside surface of shell 12, vertical second edge 54 of top section 46, and horizontal top edge 60 of bottom section 44.

When baffle plates 42 are laterally spaced longitudinally along tube bundle 14, third edge 56 will come within close proximity to the inside surface or wall of shell 12. When desired, an engagement between the inner surface of shell 12 and third edge 56 can be provided for in order to minimize the leakage of fluid through the thus formed seal 58 between shell 12 and top section 46 of baffle plate 42.

In order to induce the desired shell-side fluid flow pattern across tube bundle 14, it is preferred that baffle plates 42 be manufactured in pairs with each singular baffle being the mirror image of the other. Baffle plates 42 shall be longitudinally spaced at convenient distances along tube bundle 14. While the baffle spacing can be any desirable distance, a general rule is that the baffle spacing should not be greater than a distance equal to the inside diameter of shell 12 or closer than the distance equal to one-fifth (1/5) the inside diameter of shell 12. Baffle plates 42 are placed so that the baffle openings or cuts are alternately rotated 180° along the length of the tube bundle 14 so as to provide an up-and-down, side-to-side, zig-zag or any other similar type fluid flow pattern across tube bundle 14.

To illustrate and explain the operation of this invention, reference will be made to FIG. 5. During the operation of heat exchanger 10, metal deposits and scale, which are the products from the reactions between the heat transfer fluids and the materials of heat exchanger 10, form on the surfaces of the internal parts of heat exchanger 10 and accumulate primarily in the bottom of shell 12. By providing hinged bottom section 44, a blanked-off volume is formed in the lower section of shell 12 having no tubes 16 to fill the void of such section and which, in effect, creates a lower section 66 in which the fluid contained within lower section 66 has a low fluid volumetric velocity within shell 12 below the level of horizontal first edge 50 of the top section 46. Because of the low fluid velocity in lower section 66, scale is accumulated and collected without being carried off with the higher velocity fluid flowing above lower section 66. Furthermore, because there are no tubes 16 in the lower section 66 of shell 12, there is no scale deposition on such tubes which would otherwise have the effect of rendering such tubes ineffective, or significantly limit the value of such tubes, for heat transfer purposes. Hinging means 64 is placed so as to only allow the turning or swinging of bottom section 44 relative to top section 46 in a single or unidirection as shown by dashed lines in FIG. 5. The pivot point of bottom section 44 approximates the horizontal first edge 50 as closely as can be allowed by hinging means 64. The direction of rotation of bottom section 44 is in the opposite direction of the shell-side fluid flow. This particular arrangement is provided so that, while in operation, the force provided by the fluid flow keeps bottom section 44 in the closed position in which the bottom section 44 is in an essentially vertical position coplanar with top section 46, and in which bottom edge 62 is in close proximity with the inside surface of shell 12 preferably forming a sealing engagement between the inner surface of shell 12 and the bottom edge 62.

An additional problem that occurs in the operation of heat exchanger 10 is the formation of scale on the surfaces of the internal parts, which creates difficulty in the removal of tube bundle 14. This invention helps to resolve the problems associated with the removal of tube bundle 14 by providing a baffle plate 42 which, in effect, collapses when tube bundle 14 is removed. As shown in FIG. 5, the direction in which tube bundle 14 is removed is the same as the direction of shell-side fluid flow when heat exchanger 10 is in service. During the pulling operation of tube bundle 14, hinging means 64 on each baffle plate 42 permit the rotation or swinging or turning of the corresponding bottom sections 44. While pulling tube bundle 14, the seals made by the formation of scale at the joints between bottom edges 62 and the inside of shell 12 are easily broken. The breaking of the seals made by the formation of scale deposition permits easy removal of bundle 14. While pulling tube bundle 14, bottom sections 44 swing open to accommodate easy removal of tube bundle 14 with bottom sections 44 dragging along the top of any scale accumulation upon the bottom of shell 12.

While this invention has been described in detail for the purpose of illustration, it is not to be construed or limited thereby, but it is intended to cover all changes and modifications within the spirit and scope thereof.

That which is claimed is:

1. In a shell and tube type heat exchanger having a shell having an inside surface and containing a removable bundle of tubes, at least one tube sheet wherein the ends of the tubes of said removable bundle of tubes are operatively connected, means for introducing a first fluid to the tubes of said removable bundle and means for withdrawing the first fluid from the tubes of said removable bundle, means for introducing a second fluid to the interior of said shell and means for withdrawing the second fluid from said shell, at least one baffle extending transversely across said removable bundle so as to direct the second fluid in a desired flow pattern across the tubes of said removable tube bundle, wherein said baffle comprises:

a top section defining a plurality of apertures through which the tubes of said removable bundle extend and having a first edge, a second edge, and a third edge with the shape of said third edge corresponding to the shape of the inside surface of said shell;

a bottom section having a first edge and a second edge with the shape of said second edge corresponding to the shape of the inside surface of said shell; and hinging means connecting said first edge of said bottom section to said first edge of said top section for allowing said bottom section to rotate relative to said top section.

2. An apparatus as recited in claim 1 wherein:

said hinging means restricts the direction of rotation of said bottom section to a single direction from the plane of said top section which is opposite the direction of flow of said second fluid in said shell.

3. An apparatus as recited in claim 1 wherein:

said shell is cylindrical in shape.

4. An apparatus as recited in claim 3 wherein:

said first end of said top section is a substantially straight horizontal edge extending perpendicularly from said second edge of said top section to said third edge of said top section.

5. An apparatus as recited in claim 4 wherein:

said first edge of said bottom section is a substantially straight horizontal edge which is held in close proximity and in parallel with said first edge of said top section by said hinging means.

6. An apparatus as recited in claim 5 wherein:

said third edge of said top section and said second edge of said bottom section extend to within close proximity of the inside surface of said shell.

7. An apparatus as recited in claim 6 wherein:

said third edge of said top section and said second edge of said bottom section are sized and shaped to engage the inside surface of said shell.

8. A method of removing a removable bundle of tubes from a shell of a shell and tube type heat exchanger, said shell having an inside surface, which comprises:

equipping said removable bundle of tubes with a baffle comprising a top section defining a plurality of apertures through which the tubes of said removable bundle extend and having a first edge, a second edge, and a third edge with the shape of said third edge corresponding to the shape of the inside surface of said shell, a bottom section having a first edge and a second edge with the shape of said second edge corresponding to the shape of the inside surface of said shell, and hinging means for connecting said first edge of said bottom section to said first edge of said top section; and pulling said removable bundle in a direction so as to cause said bottom section to pivot about said hinging means in a direction opposite the direction in which said removable bundle is being pulled and so as to remove said removable bundle from said shell.

9. A method as recited in claim 8, wherein:

said pulling step is in a direction permitted by said hinging means which restricts the direction of rotation of said bottom section to a single direction from the plane of said top section.

10. A method of removing a removable bundle of tubes from a shell and tube type heat exchanger, said shell having an inside surface, which comprises:

equipping said removable bundle with a baffle comprising a top section defining a plurality of apertures through which the tubes of said removable bundle extend and having a first edge, a second edge, and a third edge with the shape of said third edge corresponding to the shape of the inside surface of said shell, a bottom section having a first edge and a second edge the shape of said second edge corresponding to the shape of the inside surface of said shell, and hinging means for connecting said first edge of said bottom section to said first edge of said top section;

flowing a fluid through said shell to force said bottom section into a vertical position and to place said second edge of said bottom section into close proximity with the inside surface of said shell so as to minimize the flow of liquid through the joint formed thereby;

withdrawing said fluid from said shell;

pulling said bundle in a direction which permits said bottom section to rotate in a direction opposite to the direction in which said bundle is pulled; and removing said removable bundle from said shell.

* * * * *